US005379568A

United States Patent [19]

Murray

[11] Patent Number: 5,379,568

[45] Date of Patent: Jan. 10, 1995

[54] METHOD AND APPARATUS FOR PROVIDING CELLULOSE-FILLED INSULATION BATTS

[76] Inventor: Earl W. Murray, Rte. 2, Box 60, Seymour, Ind. 47274

[21] Appl. No.: 867,875

[22] Filed: Apr. 13, 1992

[51] Int. Cl.[6] ..... E04B 1/00

[52] U.S. Cl. ..... 52/743; 52/406.2

[58] Field of Search ..... 52/406, 743, 745.13; 53/436, 437, 439, 440

[56] References Cited

U.S. PATENT DOCUMENTS

| | | | |
|---|---|---|---|
| 2,742,385 | 4/1956 | Bovenkerk | 52/406 |
| 2,779,066 | 1/1957 | Gaugler | 52/406 |
| 2,795,020 | 6/1957 | Kintz | 52/743 |
| 2,817,123 | 12/1957 | Jacobs | 52/406 |
| 3,003,902 | 10/1961 | McDuff | 52/406 |
| 3,264,165 | 8/1966 | Stickel | 52/406 |
| 3,307,318 | 3/1967 | Bauman | 52/406 |
| 3,837,989 | 9/1974 | McCoy | 52/406 |
| 4,172,345 | 10/1979 | Alderman | 52/406 |
| 4,172,915 | 10/1979 | Sheptak | 52/406 X |
| 4,300,322 | 11/1981 | Clark | 52/406 |
| 4,385,477 | 5/1983 | Walls et al. | 52/743 |
| 4,399,645 | 8/1983 | Murphy | 52/743 |
| 4,712,347 | 12/1987 | Sperber | 52/404 |
| 4,804,695 | 2/1989 | Horton | 524/27 |
| 4,829,738 | 5/1989 | Moss | 52/743 |
| 4,952,441 | 8/1990 | Bose | 52/406 X |

*Primary Examiner*—Carl D. Friedman
*Assistant Examiner*—Beth A. Aubrey
*Attorney, Agent, or Firm*—Woodard, Emhardt, Naughton Moriarty & McNett

[57] ABSTRACT

A method and apparatus for providing loose-fill insulation to the wall of a building. The preferred apparatus of the present invention includes a support frame or table on which an adjustable form may be positioned, an adjustable form to make an insulation batt sized to be frictionally supported in a wall, means to downwardly incline the top of the support frame, a device for providing loose-fill insulation material into a bag contained in the form, and a device to control the movement of the form down the inclined support frame as the liner bag is filled. The use of the apparatus includes determining the dimensions of a cavity in the wall of a building, adjusting the dimensions of the form to produce a loose-filled insulation batt which can be friction fit into the wall cavity to be insulated, lining the form with a thin, flexible plastic, bag-shaped liner, injecting loose-fill insulation into the liner contained within the form, sealing the edges of the liner to create a loose-fill insulation batt, and placing the loose-fill insulation batt in the wall of a building.

10 Claims, 6 Drawing Sheets

METHOD AND APPARATUS FOR PROVIDING CELLULOSE-FILLED INSULATION BATTS

FIELD OF THE INVENTION

This invention relates generally to insulation batts, and more particularly to a method of providing cellulose-filled insulation batts for new building construction.

BACKGROUND OF THE INVENTION

The use of loose-fill insulation materials such as cellulose or mineral fiber has historically been quite limited with respect to new building construction. In particular, although loose-fill materials have been applied by open-blow techniques to attics and retrofit sidewalls, efforts to introduce loose-fill materials to new construction sidewall applications have generally been unsuccessful due to the inherent nature of the loose-fill materials not to be self-supporting. Use of loose fill tends to conflict with the scheduling desires for construction. Thus, loose-fill materials have not typically been used in new building construction where it is desired to install the insulation before the wall cavity is closed.

Attempts to make cellulose batts have failed to resolve these and other problems. One reason for that failure is the necessity for factory manufactured batts to be compressed or folded for packaging and transportation to the job site. Cellulose insulating materials lack the resilience necessary to spring back to their intended design thickness. Transportation costs tend to be prohibitive if not compressed, due to the large bulk of such non-resilient batts. If compressed upon shipping, such batts are unacceptable due to the reduction in insulating capability resulting therefrom. Moreover, lack of resilience makes remote sizing to fit abnormally shaped wall cavities particularly troublesome.

The use of sprayed-on cellulosic insulation for open cavity installation is, however, known. For example, U.S. Pat. No. 4,804,695 to Horton describes a wet spray method and composition for producing and installing cellulosic insulation wherein cellulosic insulation is combined with an adhesive and a wetting agent to moisten the material before it is blown into place. When dried, the cellulose adheres to the wall surface and provides substantial insulation thereto. One disadvantage of this method is that it requires a significant drying period between the installation of the spray-on material and the closing of the wall. Because the construction process is more efficient when the wall cavity may be closed as soon as the insulation materials are applied, it would be an advantage to provide cellulosic insulation in a form which did not require post-installation drying, and could be enclosed in the wall immediately upon installation.

Additionally, non-batt methods of providing loose-fill insulation in the wall of the building are known. For example, U.S. Pat. No. 4,385,477 to wails et al. discloses a method and apparatus for placing loose-fill insulation in a structural component wherein the structural component is covered with a retainer barrier layer, a plurality of small entrances in the retainer barrier layer are provided., and loose-fill insulation is installed through those entrances.

U.S. Pat. No. 4,712,347 to Sperber describes an apparatus and method to retain loose-fill insulation between the outer and inner walls of a structure. With the Sperber method, a flexible netting material is placed on the inwardly facing sides of the studs of the wall, one or more access holes are provided in the netting, and particulate insulation is delivered into the enclosed space defined by the outer walls, the studs, and the netting. The Sperber method uses porous netting so that the displaced air may exit through the netting, thereby achieving uniform and efficient compaction of the particulate insulation. The method of Sperber would not, however, be effective with loose-fill cellulose materials. For example, bags of loose fill cellulose are preferably used at a density of approximately 3 lbs./ft$^3$ to avoid settling of the materials, but the netting of Sperber does not provide adequate structural support to allow such a density. Therefore, the netting of Sperber would sag and bow outwardly if loose fill cellulose were installed at its appropriate density without the use of a supporting surface.

U.S. Pat. No. 4,829,738 to Moss discloses a method of providing loose-fill insulation in the cavity between the studs of a wall under construction by covering the open side of the cavity with a removable pressure plate to substantially enclose the wall cavity. The pressure plate contains at least one aperture, preferably positioned near the top of the pressure plate, through which loose fill insulation may be delivered. After the installation has been installed, the pressure plate is removed and the wall cavity is enclosed by addition of the interior wall surface.

Each of the above described methods require that the loose fill insulation be blown into the wall cavity while workers are present. Unfortunately, particles of loose fill insulation become airborne during this process, and may become inhaled by workers or others at the job site. It would be an advantage if loose fill insulation were contained in a plastic envelope or bag during installation so that it could not escape to the atmosphere.

Prior to the present invention, applicant used augers to fill vertically oriented perforated paper bags with cellulose material at a density appropriate for shipping, which was higher than appropriate for wall insulation. The auger was provided with cellulose through a system similar to that disclosed herein, and having a return air path. In that system, a counterweight was used, but it was attached to a moveable auger which exited from the fixed position vertically oriented bag as the bag was filled.

Other advantages to containing the insulation in plastic envelopes can also be envisioned. In particular, the use of a plastic envelope to contain the loose-fill insulation would avoid problems relating to moisture in the product. No mold or fungus would grow in the insulation if the insulation were protected from moisture and humidity. In addition, the problem of settling would be largely avoided because the cause of settling is known to result in large degree from condensation within the product. Finally, the insulation capability (commonly stated as the R-value of the insulation) would be protected if the insulation does not become moist and clump and/or decay in the framing members.

An additional benefit to using envelopes filled with loose-fill insulation would be the increased ease of handling and ease of installation of the product. The use of envelopes would allow the construction workers to fit the insulation easily around wires, pipes, etc., by simply slitting the back of the bag and bending the back around the obstruction. Even when obstructions are not encountered, the use of insulation batts is known to be particularly simple and fast.

In addition, loose-fill cellulose insulation is known to be an especially effective insulating material. For example, while the R-value of loose-fill fiberglass is known to decrease by more than 50% when used in temperatures of −18° F. or less, the insulation value of loose-fill cellulose may even improve under those harsh conditions.

Finally, loose-fill cellulose insulating material is particularly cost effective, due to the wide availability of both new and used cellulosic materials. Many opportunities to recycle used resources are also available, thereby effecting both cost savings and environmental benefits.

In view of the forgoing, a need exists for a method of providing cellulose insulation in batts which can be easily used in new building construction. The present invention addresses that need.

SUMMARY OF THE INVENTION

A method of providing loose-fill insulation for new building construction, according to one embodiment of the present invention, includes providing a form for making loose-fill insulation belts at the job site, lining the form with a thin, plastic, bag-shaped liner, injecting loose-fill insulation into the liner bag contained within the form, sealing the open end of the bag to create a loose-fill insulation batt, and placing the loose-fill insulation batt in the wall of a building.

The preferred apparatus of the present invention includes a support frame or table on which a form may be slidably secured, a form corresponding to a cavity in the wall off a building, an auger for providing loose-fill insulation material into a bag contained in the form, and a device to allow the form to move slowly away from the auger as the liner bag is filled.

The apparatus is preferably operated while the top surface off the support frame is downwardly inclined, so that more or less insulation is deposited in the liner bag as the form is filled. Therefore, the device to allow the form to move slowly away from the auger preferably includes ball bearing members to allow the form to be slidably attached to the support frame, and a weight to counterbalance the force off gravity on the slidable form. By varying the amount of insulating material contained in the bag, the density of the loose-fill batt, and thus its insulating capability, may easily be adjusted.

One object of the present invention is to provide a method of making loose-fill insulation batts which are custom fit to specific cavities in the wall of a building.

Another object of the present invention is to provide a method of providing loose-fill insulation batts which have not been compressed by packing or transportation from a production facility.

Another object of the present invention is to provide an apparatus for making custom-sized, loose-fill insulation batts at a new building construction job site.

Related objects and advantages of the present invention will be apparent from the following description.

DESCRIPTION OF THE PREFERRED EMBODIMENT

Figure 1:
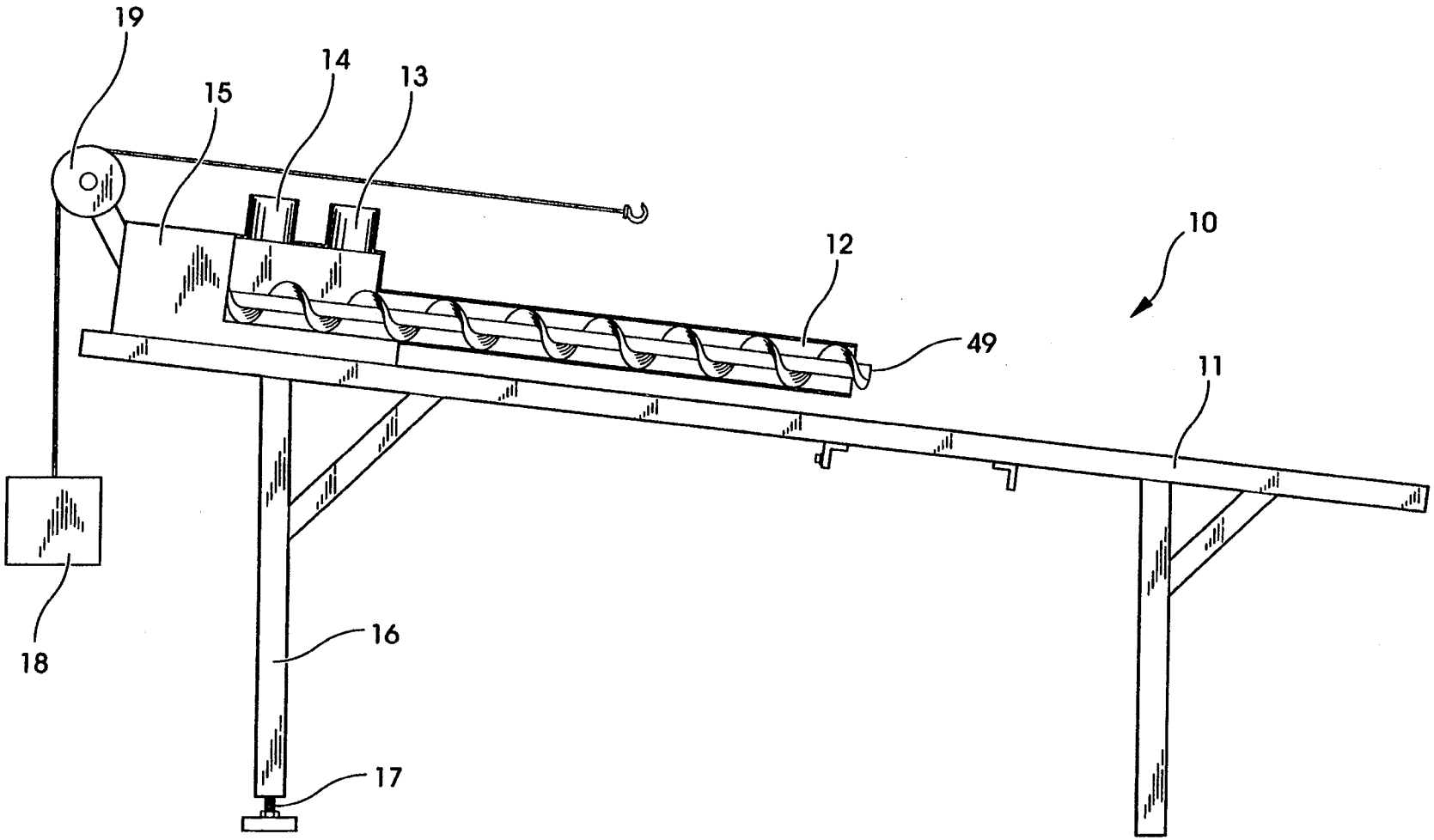
FIG. 1 is a side elevational view of the fill apparatus of the present invention, according to one preferred embodiment, with the adjustable form removed.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated apparatus and method, and such further applications of the principles of the invention as illustrated therein, being contemplated as would normally occur to those skilled in the art to which the invention pertains.

The present invention relates to a method of providing loose-fill insulation batts for the walls of new building construction. According to the preferred embodiment, there is provided an apparatus for making loose-fill insulation batts by lining an adjustable form with a flexible plastic liner, filling the liner with loose-fill insulation, and sealing the liner to make an insulation-filled batt.

Referring now to the drawings, FIG. 1 shows the batt filling apparatus of the present invention, according to one preferred embodiment, with the adjustable form removed. Apparatus 10 includes support table 11, fill auger 12, one or more insulation ducts 13 and returns 14, and auger drive 15. Table 11 is preferably supported by table legs 16, at least one of which preferably include means 17 to raise and lower the height of the table at one end. Said height-adjusting means 17 may be any device for adjusting the height of the table or leg, such as the screw-in, foot assembly shown in the drawings. The table provides an incline, by which is meant that it is neither vertical nor horizontal, but rather is between those two extremes to achieve a desired batt density upon use. Adjustment of the screw-in, foot assembly adjusts the density of the batt being filled. A counterbalancing weight 18 is hung by a pulley 19 from one end of the support table.

Figure 2:
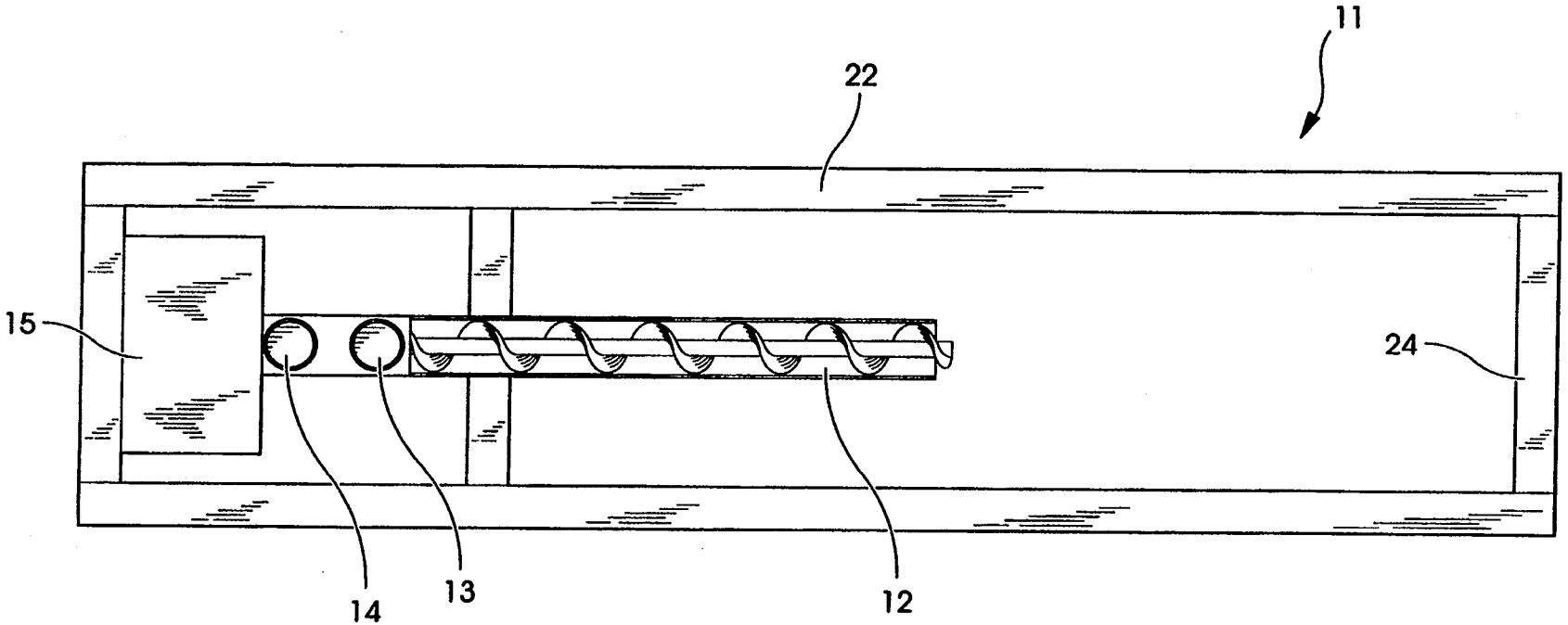
FIG. 2 is a top plan view of the fill apparatus of the present invention, according to one preferred embodiment, with the adjustable form removed.

As is shown in FIG. 2, the upper surface of table 11 may be little more than a frame. Because the function of the table is to support the auger assembly and a movable form, table 11 preferably includes a pair of parallel rails 22, with two or more cross members 24 to provide structural support. The fill auger 12, the auger drive 15, and the insulation ducts 13 and 14, are preferably positioned between the two parallel rails.

Figure 3:
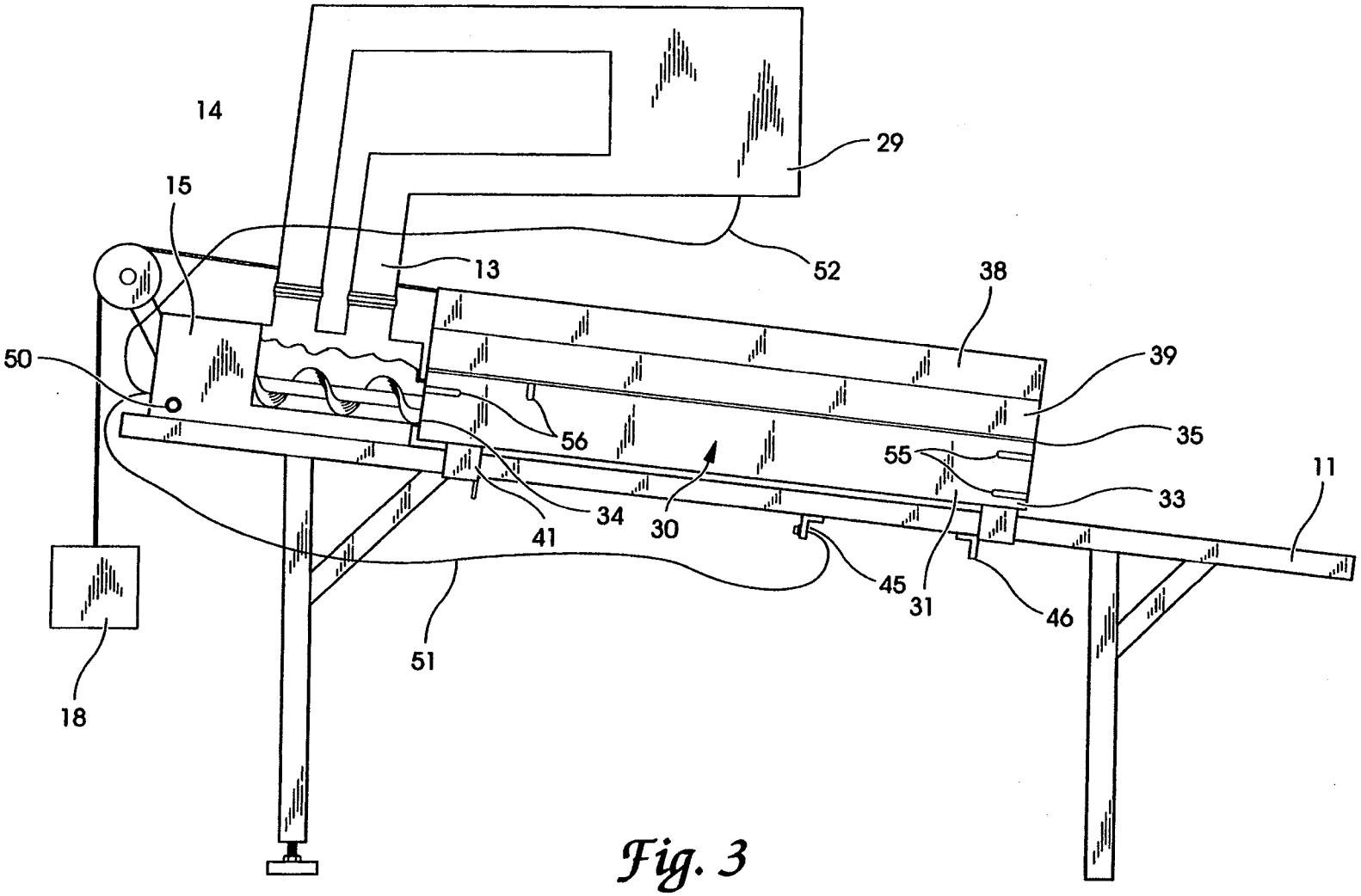
FIG. 3 is a side elevational view of the fill apparatus of the present invention, according to one preferred embodiment, with the adjustable form in its pre-fill position.
Figure 4:
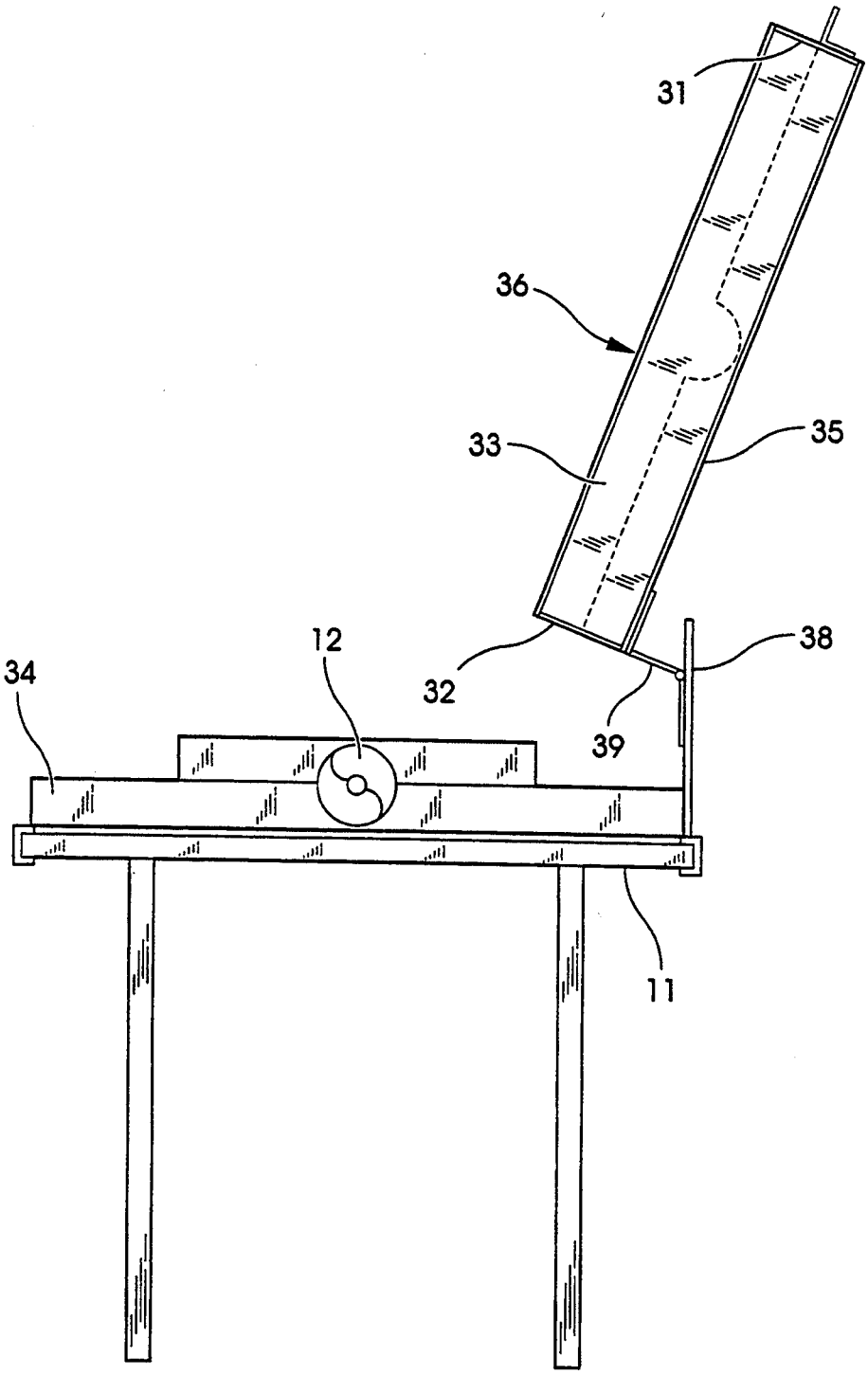
FIG. 4 is an end elevational view of the fill apparatus of the present invention, according to one preferred embodiment, with the adjustable form being open to receive a liner.

FIGS. 3 and 4 show the apparatus with the adjustable form 30 in place. Form 30 is preferably shaped as a rectangular box, having first side 31, second side 32, front end 33, rear end 34 top 35 and bottom 36. Top 35 is preferably hingedly attached to a side member 38 by hinge 39. Side member 38 also serves as a stop to prevent the top portions of the form from flipping over when the top of the form is lifted upward.

First side 31, second side 32, front end 33, top 35 and bottom 36 are all shaped as rectangular planes. Rear end 34 is in two pieces, one of which is attached to bottom 36, and the other being attached to top 35. When the lid is closed, the two pieces leave an aperture which surrounds fill auger 12 and provides a seal to prevent insulation from blowing back and out of the form.

Form 30 is preferably adjustable as to its width. Any conventional means for adjusting the size of a preform may be used, such as spring loaded pins 55 and 56 in on the side piece which can be fit into corresponding holes in the form. Thus differing stud spacing can be readily accommodated. For occasional smaller sized spaces, a smaller bag can be used even though it will not be constrained by the side walls. Since the bag material is such that two pieces can be sealed together by applying heat and pressure, bags can be fit on site using a heated roller on a standard .sized bag to seal opposite sides together, thus making the remaining volume any desired smaller size or irregular shape. In particular, it is often desirable to make a triangular, trapezoidal or other non-rectangular shaped batt.

Batts of differing lengths can be achieved by using bags of differing lengths, which length adjustment can be similarly accomplished by use of a heated roller on a standard sized bag. Batts of differing thicknesses can be made by replacing the moveable frame member with an alternate sized frame member, and using suitably differently sized bags.

Form 30 is preferably slidably attached to table 11 by attachment means 41 at each corner of the form. Attachment means 41 may include one or more inwardly extending channels which are slidably received on rails 22 of the table. In preferred embodiments, rollers or bearings are included in the channels to minimize friction between the form and the rails Alternative means to attach form 30 to table 11 may be used, it being understood that the purpose of attachment means 41 is to allow form 30 to be quickly and easily moved along the table. As will be made clear in the following description, such movement typically occurs when loose-fill insulation is provided by means of an auger.

Because the apparatus is to be operated while the rails are downwardly inclined, it is useful to provide a counterbalance to prevent the movable form from sliding down the table. Accordingly, a weight 18 is attached to the auger drive end of the form by way of a chain passing over pulley 19. The weight counterbalances the weight of the form when slidably attached to the table. Travel of the movable form toward the auger drive is limited by shop 46. Further, a limit switch stop 45 is provided to prevent the form from sliding off the end of the rails. When the limit of travel is reached limit switch stop 45 actuates, turning off the auger drive 15 and hopper/blower source 29 through wires 51 and 52. These devices to not restart until restart switch 50 is depressed to begin another filling operation.

Before operating the apparatus, a flexible plastic liner is placed in form 30. As was shown above, in preferred embodiments, form 30 includes a hinged top 35 to accommodate the easy installation of the liner in the form. The liner is of a size and shape to be friction fit inside the wall cavity to be insulated. In the preferred embodiment, the liner is sized ½ inch narrower than the cavity along all outside dimensions, to allow for expansion of the liner when filled with insulation. The liner is preferably made of staggered seal, low density, industrial polyethylene, with the most preferred material being approximately 0.0015 inches thick. It is more preferred that the thickness be between 0.001 and 0.002 inches thick, since at these dimensions, bag stretching allows a tighter fit in the wall.

After the liner has been placed in the form, the form is positioned on the table so that the distal end 49 of fill auger 12 is near the bottom of the liner bag. Cellulose is provided through insulation ducts 13 to the auger. Insulation may be provided to insulation duct 13 from a hopper/blower source 29 as is known in the art. Return 14 allows air to be returned to the hopper/blower after circulation through the apparatus. This process minimized the airborne dust which is present with certain other types of blown systems.

Figure 5:
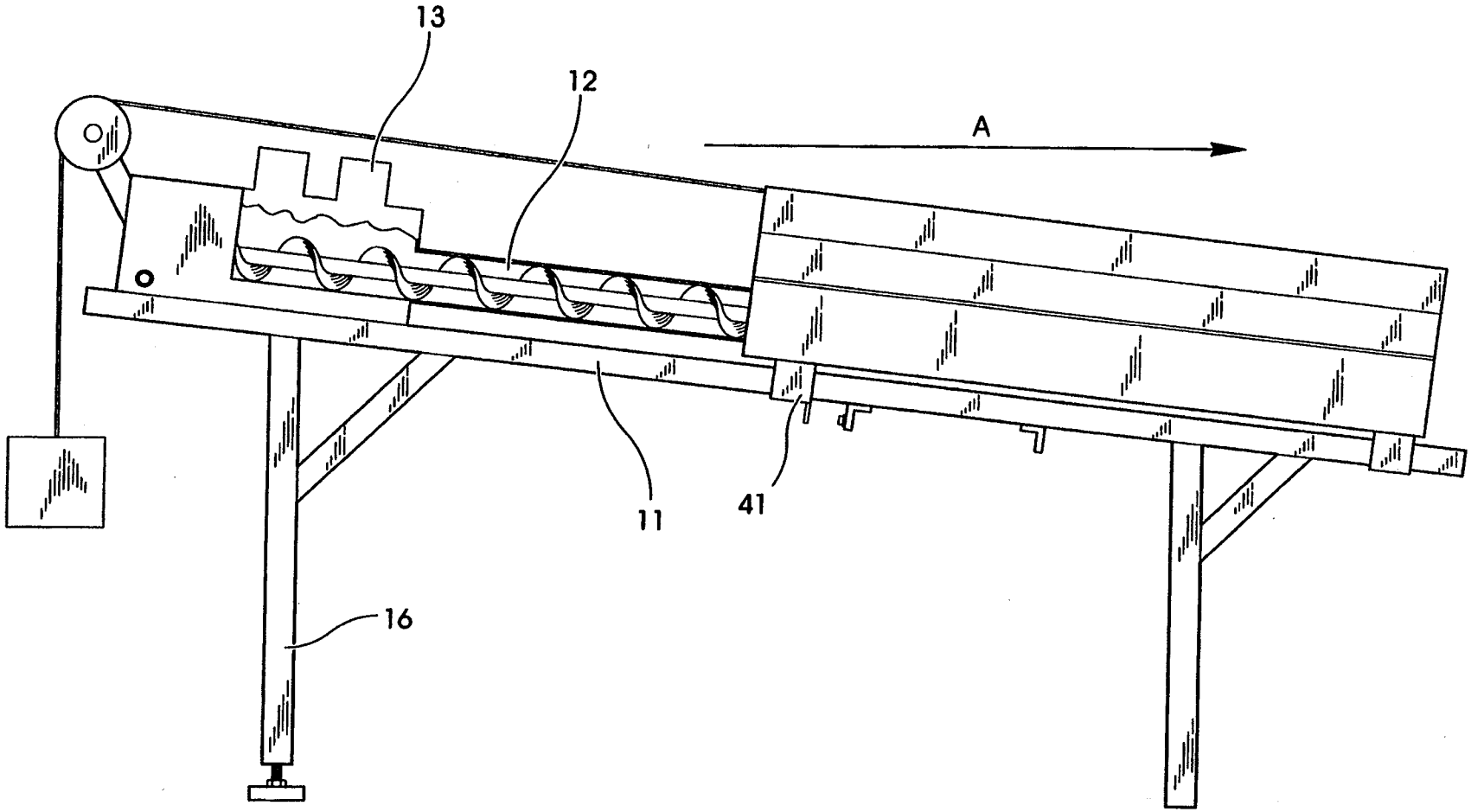
FIG. 5 is a side elevational view of the fill apparatus of the present invention, according to one preferred embodiment, with the adjustable form in its post-fill position.
Figure 6:
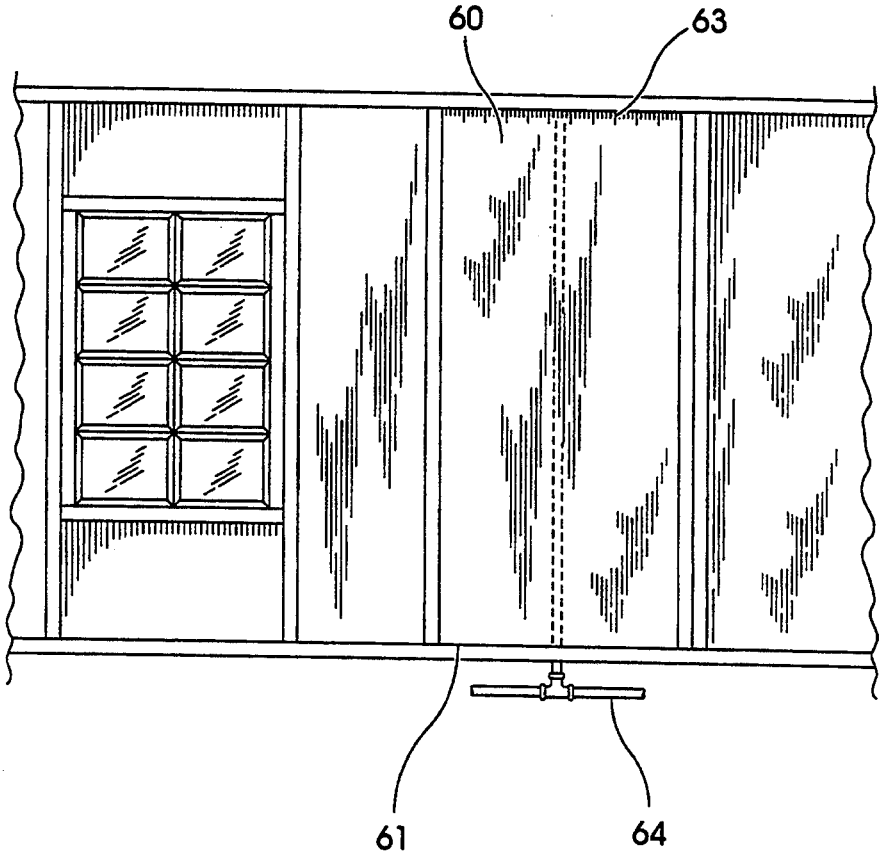
FIG. 6 is an elevational view of a wall cavity with a loose-fill insulation batt of the present invention installed.

As auger drive 15 turns the auger, the loose-fill insulation is pushed down the length of the auger, and is deposited in the liner bag enclosed in the form. As the liner bag is filled, the action of the auger moves the form away from the auger and pushes the form down the table in the direction of arrow "A" shown in FIG. 5.

The movement of the form along the table is automated so that the form moves away from the auger in proportion to the speed with which insulation is deposited into the bag. It is important that the density of the filed batt be uniform to ensure uniform insulating capability and to help prevent settling of the contents. By adjusting the height of the legs, the apparatus can be positioned at an incline to allow gravity to assist in pulling the insulation into the bag. The batt is therefore preferably filled while oriented at an inclined angle while the loose-fill insulation is being deposited therein.

In preferred embodiments the density of the finished batt is approximately three (3) pounds per cubic foot when cellulose insulation is used. This density provides a sufficient amount of insulation to provide good insulation capability and to avoid settling. If significantly less insulation is used the cellulose may settle to the bottom of the bag, decreasing the insulation capability near the top of the batt.

It is to be appreciated that alternative means to provide loose-fill insulation to the lined form are acceptable. For example, a blower assembly to blow loose-fill insulation into the bag may be used instead of the fill auger shown in the drawings. Any means, or combination of means, of providing clean, dry, loose-fill insulation to the form is intended to be within the scope of the invention.

When the liner is appropriately filled, all openings therein may be sealed to provide an insulation-filled, sealed batt. In the preferred embodiment, the liner is provided as a bag having only one open end, so that the sealing step may be accomplished with minimal time and effort. In the preferred embodiment, the end of the bag is sealed by using a heated roller, as is known to the art relating to the use of polyethylene plastics of the type preferred for use here. The heated roller is operated at a temperature of between about 300° F. to about 350° F. Other means of sealing the batt may alternatively be used, such as providing a form with heated edges which seal the batt before it is removed from the form. In addition, the bag does not need to be sealed at all. For example, seals need not be used when the bags are to be oriented "open end up" with the bottom of a second batt being placed in direct contact with the open end of the first.

When the batt has been sealed, it is ready for installation in the cavity of a wall. Because the dimensions of the batt 60 are essentially the same as the dimensions of the cavity 61, the batt will be frictionally fit into the cavity, and will not sag or slide downward. The installation is preferably accomplished by installing the bottom portion of the batt first, and then straightening the batt back and pushing it into the wall.

It is to be appreciated that the insulation batts of the present invention are easily adapted to accommodate a variety of wall cavity sizes and shapes, and that irregularly-shaped or odd-sized batts are easily made. In addition, the batts are easily fitted around wires, pipes 64 and other obstructions by slitting the back of the bag and bending the bag open at the slit before pressing the batt into the wall so that the wire or pipe is inside. The use of a conventional rolling sealer is especially convenient because the small size of the sealer allows the redesign of the bag at the job site in a matter of seconds. If desired, the liner bag may include dimensional markings 63. Dimensional markings may also be provided on the adjustable form.

It is to be appreciated that the method of the present invention provides loose-fill insulation batts which are protected from moisture. Thus, the batts are resistant to microbiological growth, such as fungus, which may grow in moist environments. In addition, the problem of settling is largely avoided. The cause of settling is, to a large degree, the result of condensation within the product, which condensation is avoided by the use of plastic liner bags which provide a moisture barrier.

Further, because the insulation is dry when installed in the wall, the wall cavity may be closed immediately after insulating. This not only makes the installation process more efficient, but the batts are additionally protected against the deterioration of their R-value because the batts do not become wet and decay in the wall cavities.

One important aspect of the invention is that the insulation batts are made at or very near the job site. In addition to being more readily sized to fit if near the job site, the batts can avoid being folded, rolled or compressed in transport if they are constructed within, say, 100 meters of the building in which they are to be installed. This on-site construction of loose-fill batts is a significant advantage over the insulation techniques of the prior art.

Finally, the method of the present invention allows the builder to avoid maintaining a large inventory of finished batts. Thus, both the dollar cost of the inventory and the space required to warehouse such a stock may be significantly reduced.

Obviously, a large number of variations are contemplated and may be included to adapt the method and apparatus of the present invention to a particular job without changing the basic design. Therefore, while the invention has been illustrated and described in detail in the foregoing drawings and descriptions, the same are to be considered illustrative and not restrictive in character. It is to be understood that the preferred embodiments have been shown and described, and that all changes and modifications that come within the spirit of the invention are desired to be protected.

What is claimed is:

1. A method of providing loose-fill insulation in a vertical cavity in the wall of a building, comprising the steps of:

(a) providing a form to correspond to a wall cavity to produce a loose-fill insulation batt sized to fit said wall cavity;

(b) lining the form with a flexible liner having an opening therein;

(c) providing loose-fill insulation into said flexible liner, while the liner is enclosed in the form, to make a loose-fill insulation batt; and thereafter (d) placing said loose-fill insulation batt vertically in said vertical wall cavity.

2. A method according to claim 1, and further including the step of sealing the opening of said insulation-containing liner to make a sealed, loose-fill insulation batt.

3. A method according to claim 1, wherein said loose-fill insulation is made of cellulose.

4. A method according to claim 1, wherein said loose-fill insulation is provided using an auger.

5. A method according to claim 1, wherein said flexible liner is made of plastic.

6. A method according to claim 5, wherein said flexible liner is between about 0.0010 inches and 0.0020 inches thick.

7. A method according to claim 5 wherein said flexible liner is sealed with heat, at a temperature of between about 200° F. to about 400° F.

8. A method according to claim 5, wherein said flexible liner is sealed using a heated roller.

9. A method according to claim 1, wherein said insulation providing step is accomplished within 100 meters of said wall cavity.

10. A method according to claim 1 wherein said loose-fill insulation batt is substantially non-rectangular shaped.

* * * * *